United States Patent [19]

Tsuchida

[11] 4,211,902

[45] Jul. 8, 1980

[54] APPARATUS FOR PHASE SWITCHING IN PUMPING-UP POWER STATION

[75] Inventor: Hiroaki Tsuchida, Yokohama, Japan

[73] Assignee: Tokyo Shibaura Electric Co., Ltd., Kawasaki, Japan

[21] Appl. No.: 789,435

[22] Filed: Apr. 20, 1977

[30] Foreign Application Priority Data

Apr. 27, 1976 [JP] Japan ..... 51-48034

[51] Int. Cl.[2] ..... H01H 33/54

[52] U.S. Cl. ..... 200/148 R; 200/148 F; 200/148 D

[58] Field of Search ..... 200/148 D, 148 G, 148 F

[56] References Cited

U.S. PATENT DOCUMENTS

| | | | |
|---|---|---|---|
| 2,723,367 | 11/1955 | Bockman | 200/148 D |
| 2,955,182 | 10/1960 | Caswell et al. | 200/148 G |

FOREIGN PATENT DOCUMENTS

| | | | |
|---|---|---|---|
| 650175 | 9/1937 | Fed. Rep. of Germany | 200/148 F |
| 698807 | 11/1940 | Fed. Rep. of Germany | 200/148 F |
| 1103007 | 2/1968 | United Kingdom | 200/148 D |

*Primary Examiner*—Robert S. Macon

*Attorney, Agent, or Firm*—Oblon, Fisher, Spivak, McClelland & Maier

[57] ABSTRACT

Apparatus for phase switching in a pumping-up power station includes a phase switching device to switch over between pumping-up and generating. The phase switching device includes a pair of disconnecting switches for pumping-up and generating integrally accommodated in a sealed casing filled with sulphur hexa-fluoride ($SF_6$) gas and an actuating mechanism for actuating the disconnecting switches.

6 Claims, 6 Drawing Figures

APPARATUS FOR PHASE SWITCHING IN PUMPING-UP POWER STATION

BACKGROUND OF THE INVENTION

1. Field of the Invention

This invention relates to gas insulated switch-gear in a pumping-up power station, and, more particularly, to an apparatus for phase switching between the pumping-up and generating operations in a pumping-up power station.

2. Description of the Prior Art

The recently developed hydraulic power station is being gradually replaced by the pumping-up power station because of operation efficiency. The housing therefor is a tunnel structure of underground structure which does not impair the adjacent environment. As a result, a switch gear employing sealed sulphur hexafluoride ($SF_6$) has more restrictive sizing requirements.

On the other hand, the pumping-up power station needs apparatus for phase switching in order to permit the generator to function as a motor.

It is known that reversing the rotation of a three-phase motor is effected by reversing the connection of two of the three terminals. Accordingly, changing the generator from generator to motor is effected by reversing two switches. Two disconnecting switches, i.e. $DS_1$ of the generator and $DS_2$ of the motor, have been employed and phase-switched by alternative operation.

FIG. 1 shows a connecting diagram of the pumping-up power station. In FIG. 1, the generator G works as a pumping motor as described above. Tr designates a transformer, DS a main disconnecting switch, GCB a gas circuit breaker, $DS_1$ and $DS_2$ disconnecting switches for phase switching as described above, and BUS a bus bar.

A load (not shown) is connected to the bus bar BUS through a disconnecting switch DSa, a circuit breaker CB and a disconnecting switch DSb.

In such a structure, the disconnecting switch $DS_2$ of the motor side as described above is necessary to phase-switch the generator from a generating operation to a motoring operation and to then connect the bus bar to another power line to operate the generator G as a motor. If the disconnecting switches $DS_1$ and $DS_2$ are closed together, a shorting fault occurs.

Accordingly, the disconnecting switches $DS_1$ and $DS_2$ must satisfy the following conditions. When the disconnecting switch $DS_1$ of the generator side is closed, the disconnecting switch $DS_2$ of the motor side must be open and vice versa, and the disconnecting switches $DS_1$ and $DS_2$ can be opened together.

In order to satisfy such conditions, an interlocking mechanism as shown in FIG. 2 is provided between the disconnecting switches $DS_1$ and $DS_2$.

A link LK with a clearance is provided between an actuating lever $L_1$ of the disconnecting switch $DS_1$ and an actuating lever $L_2$ of the disconnecting switch $DS_2$.

One end barring the clearance of the link LK is engaged with the lever $L_1$ of the disconnecting switch $DS_1$. Thus, the interlock mechanism IM comprises the link LK. In FIG. 2, like reference characters designate identical or corresponding parts as shown in FIG. 1.

However, since there is an interlocking mechanism, the structure of the arrangement and its adjustment are complicated. Further, since there are two disconnecting switches $DS_1$ and $DS_2$ separated from each other, the arrangement in general requires a great deal of space.

SUMMARY OF THE INVENTION

Accordingly, it is an object of this invention to provide a new and improved unique closed-up type switch gear which has a small size and a simple structure.

The foregoing and other objects are attained in accordance with one aspect of the present invention through the provision of an apparatus for phase switching between the pumping-up operation and the generating operation in a pumping-up power station, the apparatus comprising a sealed casing filled with an insulating gas, a pair of disconnecting switches which have a stationary contact and a movable contact and are integrally accomodated in the sealed casing, an actuating means for actuating the movable contacts so as to move reversely with respect to each other, and means for connecting the movable contacts.

BRIEF DESCRIPTION OF THE DRAWING

Various objects, features and attendant advantages of the present invention will be more fully appreciated as the same becomes better understood from the following detailed description of the present invention considered in connection with the accompanying figures of the drawing, in which.

DESCRIPTION OF THE PREFERRED EMBODIMENTS

Figure 3:
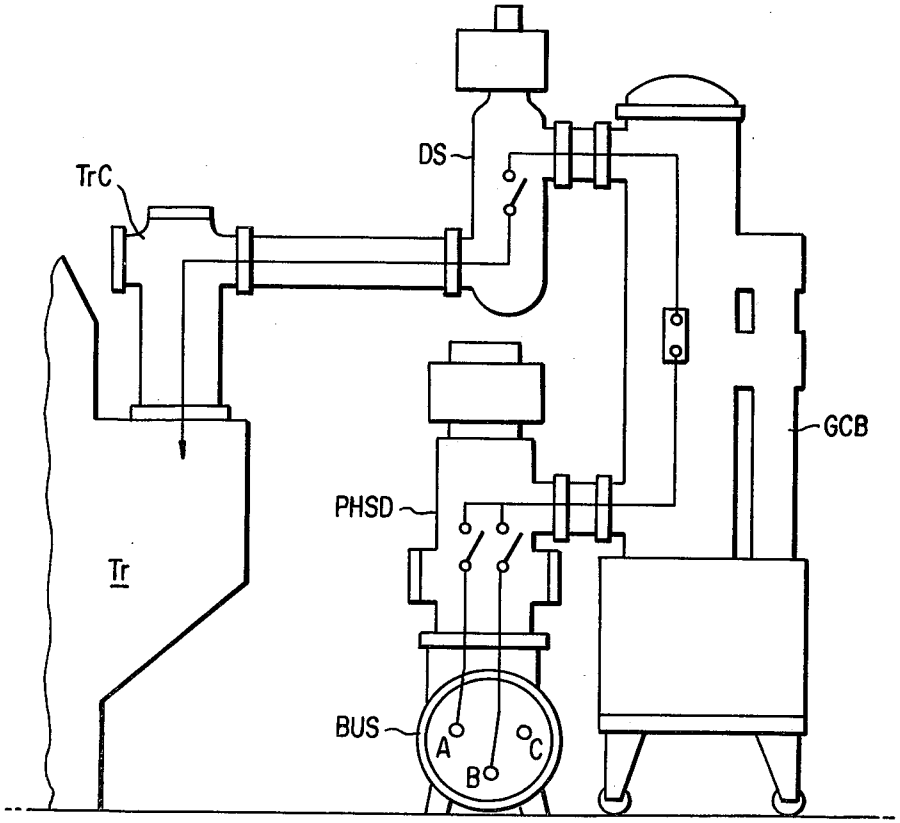
FIG. 3 shows a front view, partly in a connecting diagram, of a preferred embodiment of the invention.

Referring now to the drawing, wherein like reference characters designate identical or corresponding parts throughout the several views, and more particularly to FIG. 3 thereof, a phase switching device PHSD is mounted on a bus bar unit BUS and a gas circuit breaker GCB is mounted on a side portion of switching device PHSD.

A main disconnecting switch DS is mounted between an upper portion of the gas circuit breaker GCB and a connecting part TrC of a transformer Tr.

The bus bar BUS, the phase switching device PHSD, the main disconnecting switch DS and the connecting part TrC communicate with each other and are filled with an insulating gas such as $SF_6$ gas.

Three phase switching devices are provided at each three-phase terminal. For example, a first phase switching device exchanges the connections A and B of the bus bar BUS and a second phase switching device exchanges the connections B and A of the bus bar BUS to reversely connect the connection of the first phase switching device. A third phase switching device acts only as a disconnecting switch with respect to the connection C. Only the first phase switching device is explained.

Figure 1:
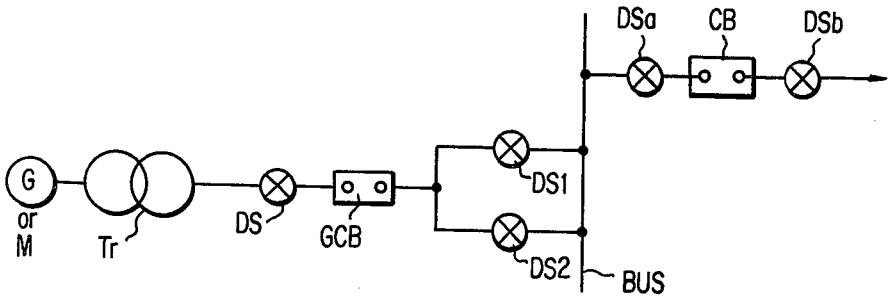
FIG. 1 shows a single connecting diagram of a pumping-up power station.
Figure 2:
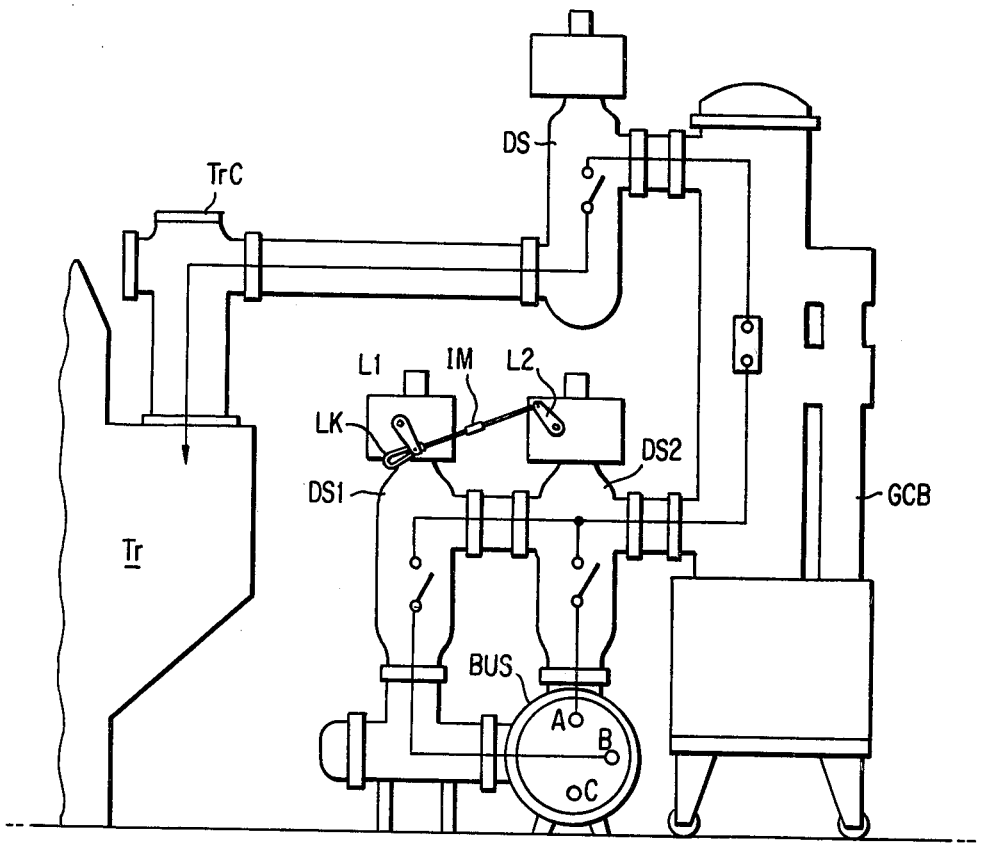
FIG. 2 shows a front view, partly in a connecting diagram, of a prior arrangement.
Figure 4:
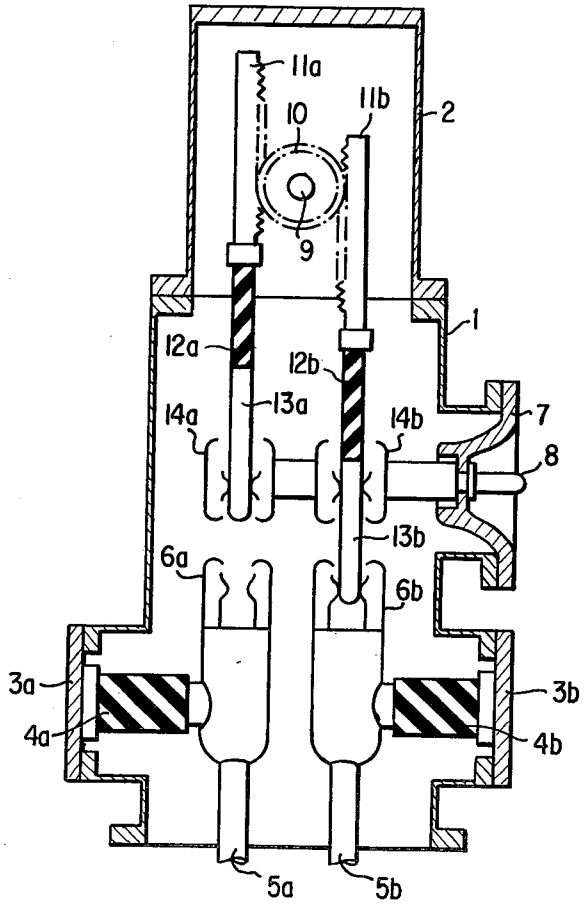
FIGS. 4 and 5 are schematic views showing an enlarged portion of the phase switching mechanism shown in FIG. 3, before and after the mechanism is operated.

FIG. 4 is a schematic view of an enlarged portion of the phase switching device PHSD shown in FIG. 3. In FIG. 4, a case 2 is mounted on top of a tank 1 for enclosing an operating mechanism as described hereinafter. Covers 3*a* and 3*b* are mounted to conducting members 5*a* and 5*b* through insulating members 4*a* and 4*b*. Opening-projecting portions are provided in the under portion of the tank 1 to facilitate mounting.

The conducting members 5*a* and 5*b* have a stationary contact fixed thereon which is coupled to the bus bars A and B shown in FIG. 3. An insulating spacer 7 having a connector 8 connected to the gas circuit breaker GCB is mounted on a side wall of the tank 1. A shaft 9 fixed on a pinion 10 of a rack and pinion mechanism is supported by the case 2 so as to rotate freely. A pair of movable racks 11*a* and 11*b* which are free to move up and down and which hold the pinion 10 therebetween are provided at both sides of the pinion 10 so as to move oppositely with respect to each other by rotating the pinion 10.

A pair of series bodies consisting integrally of insulating rods 12*a* and 12*b* and movable contacts 13*a* and 13*b*, to be engaged to the stationary contacts 6*a* and 6*b*, are respectively rigidly mounted on one side of the respective racks 11*a* and 11*b*.

Intermediate contactors 14*a* and 14*b* are electrically connected to the connector 8 and slidingly contact movable contacts 13*a* and 13*b*.

The stationary contact 6*a* and movable contact 13*a* constitute disconnecting switch $DS_2$. The stationary contact 6*b* and the movable contact 13*b* constitute the disconnecting switch $DS_1$.

The operation of the phase switching device PHSD shown in FIG. 4 and FIG. 5 will now be described.

Figure 5:
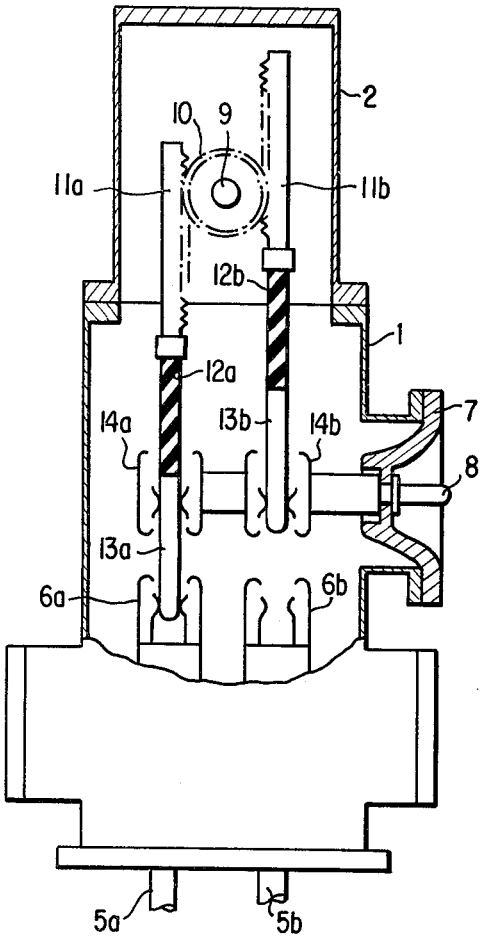

FIG. 5 shows the phase switching device PHSD when the switching over as described hereinafter is completed, namely when the pumping-up is switched over.

In the phase switching device PHSD, usually, i.e. when the generator G is operated as a generator, the current flows from the connector 8, connected to one terminal of the gas circuit breaker GCB, to the bus bar B through the intermediate contactor 14*b*, the movable contact 13*b*, the stationary contact 6*b* and the conducting member 5*b*.

In the condition shown in FIG. 4, in the event that the phase switching device PHSD switches over after the gas circuit breaker is opened, the movable contact 13*b* is separated from the stationary contact 6*b* by the rising of the rack 11*b* when the pinion 10 is rotated counterclockwise by an actuator (not shown) coupled to the shaft 9 in accordance with the switchover command.

On the other hand, the pinion 10 causes the rack 11*a* to move down and both movable contacts 13*a* and 13*b* are separated from stationary contacts 6*a* and 6*b* when the movable contact is reached at an intermediate point of the stroke.

In this condition, if the operation of the rack and pinion mechanism is stopped, both disconnecting switches $DS_1$ (6*b*–13*b*) and $DS_2$ (6*a*–13*a*) assume the open state and the insulation between the stationary contact and the movable contact is maintained by the $SF_6$ gas.

Furthermore, if the pinion 10 is rotated counterclockwise by the actuator, the movable contact 13*a* for pumping-up (motor) approaches the stationary contact 6*a* and then is closed (FIG. 5).

In the event that the state shown in FIG. 4 is switched over to the state shown in FIG. 5, the phase switching device PHSD can be effected by clockwise rotation of the pinion 10 and can be switched over from pumping-up to generating.

Figure 6:
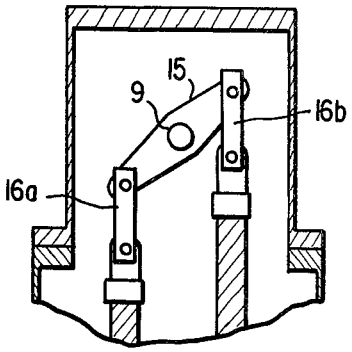
FIG. 6 illustrates a modification of the phase switching mechanism shown in FIG. 3.

FIG. 6 illustrates another embodiment of the phase switching mechanism shown in FIG. 3.

The embodiment described above is a combination of the pinion 10 and the racks 11*a* and 11*b*. However, the embodiment shown in FIG. 6 substitutes a link mechanism for the combination rack and pinion mechanism. The link mechanism comprises a lever 15 integrally fixed on the shaft 9 and links 16*a* and 16*b* which are free to rotate and which are respectively provided between the end portion of the lever 15 and the insulating rods 12*a* and 12*b*.

According to the invention as described above, since the phase switching device PHSD has a pair of stationary contacts and movable contacts for phase switching, which are accomodated in the same casing, it is possible to make the unit quite compact. The structure of the gas sealed switch gear can also be reduced.

Furthermore, as the movable contacts move reversely with respect to each other by the operation of the rack and pinion mechanism or the link mechanism, it is unnecessary to have a special interlock mechanism. It is therefore possible to simplify the mechanism of the phase switching device.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. An apparatus for phase switching between a pumping-up operation and a generating operation in a pumping-up power station, the improvement comprising:

a sealed casing filled with an insulating gas;

a pair of disconnecting switches having a stationary contact and a movable contact, the disconnecting switches being integrally accommodated in the sealed casing;

an actuating means for linearly actuating the movable contacts so as to cause reverse movement with respect to each other such that only one selected movable contact at any time contacts the stationary contact of the switch associated therewith to prevent shorting; said pair of disconnecting switches being connected in a configuration whereby one movable contact is opened while the other movable contact is still open during actuation thereof; and, means for connecting the movable contacts; said means for connecting the movable contacts being a pair of intermediate contacts, integrally accommodated in the sealed casing, for establishing electrical connection between said pair of disconnecting switches and associated apparatus in said apparatus for phase switching, said pair of intermediate contacts being in sliding contact with each of the movable contacts.

2. An apparatus for phase switching as in claim 1 wherein the insulating gas is $SF_6$ gas; the insulation between the movable contact and the stationary contact being maintained by said $SF_6$ gas whenever both of the movable contacts are opened simultaneously.

3. An apparatus for phase switching as in claim 1 wherein the actuating means comprises a pinion which is mounted on the wall of the casing so as to be freely rotatable and a pair of movable racks which are free to move up and down in connection with the movable contacts to move reversely with respect to each other upon rotation of the pinion.

4. An apparatus for phase switching as in claim 1 wherein the actuating means comprises a lever which is free to rotate and is mounted on the wall of the casing and a pair of links which are disposed between the respective movable contacts and the ends of the lever.

5. An apparatus for phase switching as in claim 1 wherein the actuating means comprises an insulating rod connected to the movable contact.

6. An apparatus for phase switching as in claim 1 further comprising:

a generator in the pumping-up power station;

a transformer connected to the generator;

a main disconnecting switch connected to the transformer;

a circuit breaker connected between the main disconnecting switch and the means for connecting the movable contacts; and, a bus bar connected between the stationary contacts of the disconnecting switches and a load and another power line; said disconnecting switches being in series with said bus bar and said circuit breaker and in parallel with each other.

* * * * *